US006524098B1

(12) United States Patent
Tsirulnikov et al.

(10) Patent No.: US 6,524,098 B1
(45) Date of Patent: Feb. 25, 2003

(54) BURNER ASSEMBLY WITH SWIRLER FORMED FROM CONCENTRIC COMPONENTS

(75) Inventors: Lev Tsirulnikov, Brooklyn, NY (US); Michael Gamburg, San Francisco, CA (US); Michael Brecker, Fairfield, CT (US); Glen Altpfart, Monroe, CT (US); John Guarco, Wolcott, CT (US); Richard Waibel, Broken Arrow, OK (US)

(73) Assignee: John Zink Company LLC, Tulsa, OK (US)

( * ) Notice: Subject to any disclaimer, the term of this patent is extended or adjusted under 35 U.S.C. 154(b) by 0 days.

(21) Appl. No.: 09/571,483

(22) Filed: May 16, 2000

(51) Int. Cl.[7] ..... F23M 9/00; F23D 14/46; B05B 7/10

(52) U.S. Cl. ..... 431/9; 431/350; 431/182; 431/185; 239/406; 239/404

(58) Field of Search ..... 431/5, 354, 181, 431/182, 183, 185, 8, 9, 350; 239/399, 402, 403, 404, 405, 402.5, 406

(56) References Cited

U.S. PATENT DOCUMENTS

| | | | | |
|---|---|---|---|---|
| 1,602,180 A | * | 10/1926 | Stillman | 431/183 |
| 3,713,588 A | * | 1/1973 | Sharpe | 239/406 |
| 3,796,536 A | * | 3/1974 | Hori et al. | 239/405 |
| 3,937,011 A | * | 2/1976 | Caruel et al. | 239/406 |
| 4,600,377 A | * | 7/1986 | Musil | 431/183 |
| 4,708,638 A | | 11/1987 | Brazier et al. | 431/116 |
| 4,927,352 A | * | 5/1990 | Chung | 431/184 |
| 5,078,064 A | | 1/1992 | Breen et al. | 110/212 |
| 5,169,304 A | | 12/1992 | Flament et al. | 431/183 |
| 5,350,293 A | | 9/1994 | Khinkis et al. | 431/116 |
| 5,365,865 A | * | 11/1994 | Monro | 431/183 |
| 5,470,224 A | | 11/1995 | Bortz | 431/182 |
| 5,823,764 A | * | 10/1998 | Alberti et al. | 431/184 |
| 5,827,054 A | * | 10/1998 | Sarv et al. | 431/184 |

FOREIGN PATENT DOCUMENTS

| | | | |
|---|---|---|---|
| EP | 0 002 815 A2 | * | 7/1979 |
| JP | 61-52522 A | * | 3/1986 |

OTHER PUBLICATIONS

GRC Low NOx Burners by Procedair Industries, undated.

* cited by examiner

*Primary Examiner*—Henry Bennett
*Assistant Examiner*—Josiah C. Cocks
(74) *Attorney, Agent, or Firm*—James H. Marsh, Jr.; Stinson Morrison Hecker LLP

(57) ABSTRACT

A burner assemblage includes an elongated, round burner assembly having a central axis and including internal baffle structure. The baffle structure is arranged to cause concentric primary and secondary air flows to move in a direction generally parallel to said axis. The secondary air flow is generally annular in shape and the same is disposed in generally surrounding relationship relative to said primary air flow. The assemblage also includes a swirler structure for swirling the air primary and secondary air flowing through the central portions of the burner. The swirler structure includes a first swirler component located in a position for swirling the primary air flow. The first swirler component has an outer circumferential edge that extends around the axis of the burner in radially spaced relationship thereto. The swirler also includes a second generally annular swirler component located in a position for swirling the secondary air flow independently of the swirling of the primary air flow. The second swirler component has an internal annular edge that extends around the axis in spaced relationship thereto. The internal annular edge of the second swirler component is greater in diameter than the outer circumferential edge of the first swirler component so that the two swirler components may be arranged concentrically in essentially the same plane. Ideally the swirler components are arranged to swirl the respective primary and secondary air flows in the same general direction and with essentially the same intensity.

25 Claims, 8 Drawing Sheets

BURNER ASSEMBLY WITH SWIRLER FORMED FROM CONCENTRIC COMPONENTS

BACKGROUND OF THE INVENTION

1. Field of the Invention

The present invention relates to the field of industrial fluid fuel fired burners and in particular to swirler mechanisms used in such burners for flame stabilization. Even more particularly, the invention relates to a two component swirler whereby two separate portions of primary gases are swirled separately to stabilize flame while maintaining low $NO_x$ levels in burner effluent gases.

2. The State of the Prior Art

The presence of $NO_x$ in furnace flue gases is a constant problem facing the burner industry. Many prior inventions and developments in the burner field address this problem by providing various mechanisms and methodologies in an effort to minimize and/or control $NO_x$ emissions. In particular it is believed productive to reduce flame temperature, to control flame profile and to combust the fuel with a minimum of excess air so as to minimize the presence of incomplete combustion products, including CO in the furnace flue gases. It is also desirable to make sure that the produced flame is stable and controlled. A known furnace arrangement which employs a swirler in an effort to stabilize and control the produced flame is illustrated and described in co-pending application Ser. No. 09/335,007, filed Jun. 17, 1999 (the "'007 application"). The '007 application is owned by the assignee of the present application and the entirety of the disclosure thereof is hereby specifically incorporated herein by reference. The optimization of these various parameters requires tradeoffs, and as a result, the routineers in the burner field constantly seek improvements which will provide relief from a given problem without causing problems somewhere else.

SUMMARY OF THE INVENTION

A major and primary object of the invention is to provide for efficient and reliable operation of a burner while minimizing the presence of emissions such as CO and $NO_x$ in the flue gas. In particular, the invention provides a novel swirler which provides flame stability and efficiency of operation while minimizing effluent emissions. To this end the invention provides an air swirler structure for an elongated burner having a central axis and concentric primary and secondary air flows moving in a direction generally parallel to said axis. The arrangement is such that the primary air flow is surrounded by the secondary air flow.

The swirler structure includes a first swirler component located in the air flow for swirling the primary air and gas flows. This first swirler component has an outer edge that extends around the axis in radially spaced relationship thereto. The swirler structure also includes a second generally annular swirler component located as well in the air flow for swirling the secondary air flow independently of the swirling of the primary air flow. This second swirler component has an internal edge that extends around the axis in spaced relationship thereto. The diameter of the internal edge of the second swirler component is preferably greater than the outer edge of the first swirler component.

In a preferred form of the invention, the first and second swirler components are arranged in a common plane that extends transversely relative to said axis. Ideally, the swirler components are arranged in a common plane that is perpendicular to the axis. Generally speaking at least the primary air flow comprises a mixture of air and fuel for the burner.

The first swirler component may generally be annular in shape and may have an inner circular edge, and, in a preferred form of the invention, the swirler structure may include a centrally located, elongated cylindrical hub that extends along the burner axis in coaxial relationship thereto. In this form of the invention, the inner circular edge may be disposed in a generally surrounding relationship relative to an outer periphery of said hub.

In a particularly preferred form of the invention, the swirler components may each be generally annular in shape, and the second swirler component may have an outer peripheral rim having a diameter that ranges from about 1.5 to about 1.8 times the diameter of the outer edge of the first swirler component. Preferably the swirler components are arranged to swirl the respective primary and secondary air flows in the same general direction and with essentially the same intensity.

The invention also may provide a burner assemblage comprising an elongated, round burner assembly having a central axis and including internal baffle structure causing concentric primary and secondary air flows to move in a direction generally parallel to said axis, causing the secondary air flow to be generally annular in shape, and causing the secondary air flow to be disposed in generally surrounding relationship relative to the primary air flow. The burner assemblage also may include a swirler structure for swirling the air flow such as has been described above. In a particularly preferred form of the invention, the burner assemblage may comprise a venturi tube arranged to provide swirled flows of primary and secondary air and a surrounding straight flow of tertiary air. Ideally, the burner assemblage may be constructed and arranged to direct a flow of quaternary air around the outside of the venturi tube.

Another embodiment of the invention provides a method for operating an elongated, round burner assembly having a central axis is provided. The method comprises providing a flow of combustion air for the burner assembly and dividing this flow of combustion air into swirled concentric primary and secondary air flows and straight tertiary and quaternary air flows. In accordance with the principles and concepts of the invention, the secondary air flow may generally be annular in shape and the same may be disposed in generally surrounding relationship relative to said primary air flow.

The method also includes a step of causing the primary and secondary air flows to move through the burner assembly in a direction that is generally parallel to the burner axis. In accordance with the method of the invention, the primary air flow is swirled in a first direction at a first swirling intensity and the secondary air flow is swirled independently in a second direction at a second swirling intensity. Ideally, the primary and secondary air flows are independently swirled in essentially the same swirling direction and at essentially the same intensity.

DETAILED DESCRIPTION OF THE PREFERRED EMBODIMENTS

Figure 1:
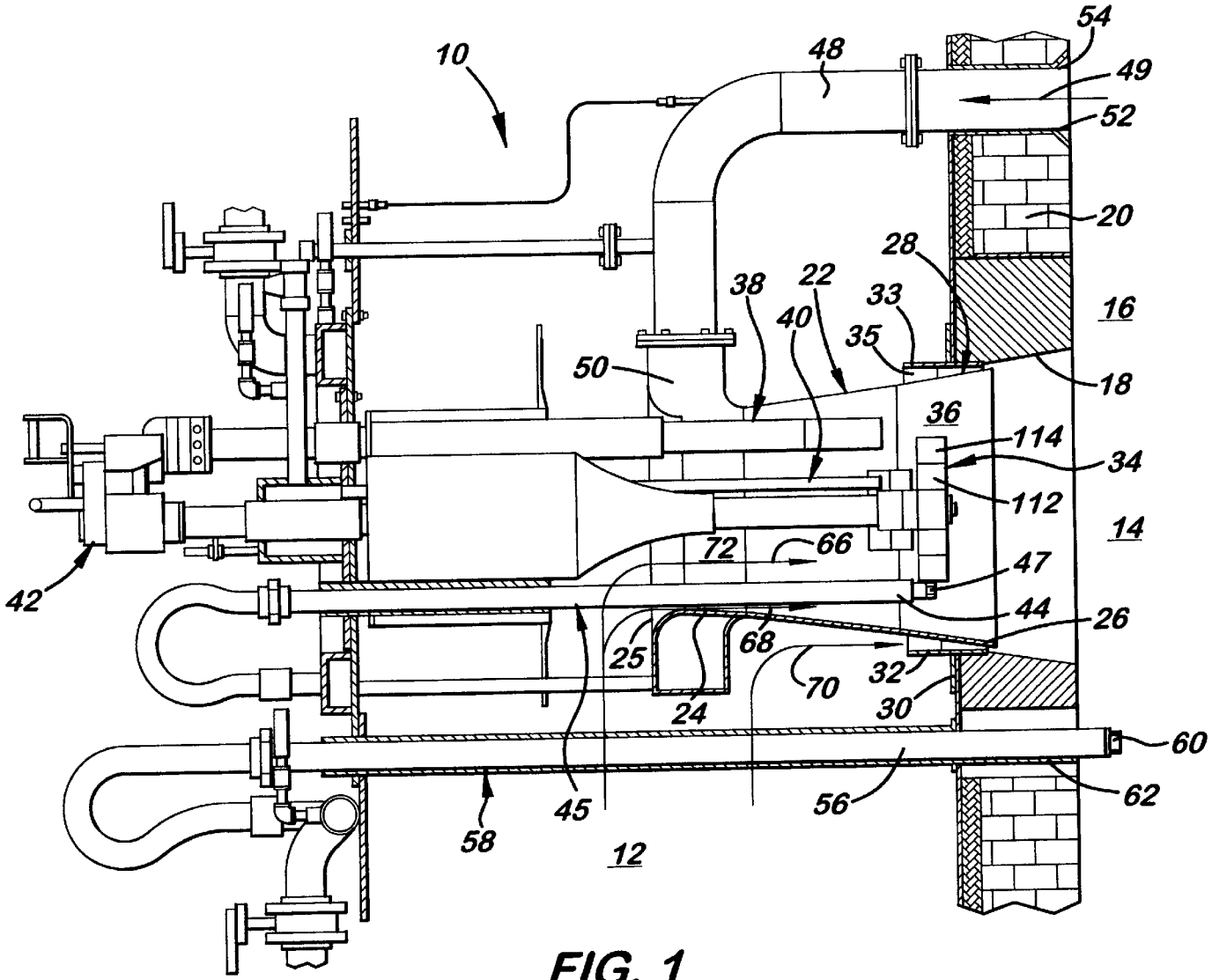
FIG. 1 is a schematic elevational view, partly in cross section, of an embodiment of a combustion chamber burner of the invention and its associated elements.

A burner assembly which embodies features, concepts and principles of the invention is illustrated in FIG. 1 where it is identified by the reference numeral 10. As is conventional and well known to those of ordinary skill in the relevant art, the pressurized type burner 10 may be surrounded by a windbox 12 which provides combustion air to the burner at a pressure sufficient to cause it to flow into the combustion zone 14 in a combustion chamber or firebox 16 through an entrance 18 in a wall 20 of the combustion chamber 16. As is also well known to those of ordinary skill in the art, an entrance, such as the entrance 18, may preferably be in the form of a generally circular opening which extends through the wall 20 of combustion chamber 16.

The burner 10 may be equipped with an elongated venturi tube 22 having an inlet end 25 that is spaced from entrance 18 and a outlet end 26 that is positioned adjacent to and in alignment with entrance 18 to zone 14. The venturi tube 22 also has a throat 24 disposed between inlet end 25 and outlet end 26. As would be well known to the routineer in the burner art, the venturi tube 22 may generally be circular in cross-sectional configuration, and the outlet end 26 thereof should preferably and generally be larger in diameter than either the inlet end 25 or the venturi tube throat 24, commonly known as vena contracta.

As illustrated in FIG. 1, outlet end 26 of venturi tube 22 may preferably be positioned within and surrounded by entrance 18. Additionally, the outer periphery 28 of outlet end 26 is smaller in diameter than the annular inner edge surface 30 of entrance 18. Thus, an annular gap 32 is presented between the outer periphery 28 of the outlet end 26 of the venturi tube 22 and the inner edge surface 30. An annular shroud 33 is positioned within entrance 18 and is mounted on edge surface 30 so as to provide a mouth 35 for the gap 32.

The burner assembly 10 is also provided with a swirler 34 which is positioned centrally within the outlet end 28 of the venturi tube 22. As can be clearly seen in FIG. 1, the outer diameter of the swirler 34 is smaller than the internal diameter of the venturi tube 22 at the outlet end 28 of the latter. This provides an annular space 36 which surrounds the swirler 34 within the venturi tube 22. In accordance with the invention, the swirler 34 may preferably be constructed of concentric inner and outer components 112, 114 which will be described in greater detail hereinafter.

The burner assembly 10 of the invention also may preferably be provided with a conventional ignitor 38 and one or more central fired gas gun nozzles 40. Only a single nozzle is shown in FIG. 1; however, one of ordinary skill in the burner art would understand that the burner 10 may include a plurality of central fired gas gun nozzles spaced evenly around the longitudinal axis of the venturi tube 22. The determinative factor in choosing the number of central fired gas gun nozzles to use is simply to make sure that the central or primary gas flow is evenly distributed in the combustion air. The nozzle or nozzles 40, as the case may be, provide fuel gas to the air flowing through the center of the venturi tube 22. The burner assembly 10 may also preferably be equipped with a conventional steam operated fuel oil atomizer unit 42 so that the burner 10 is adapted to burn fuel oil as well as gaseous fuels including natural gas.

Figure 2:
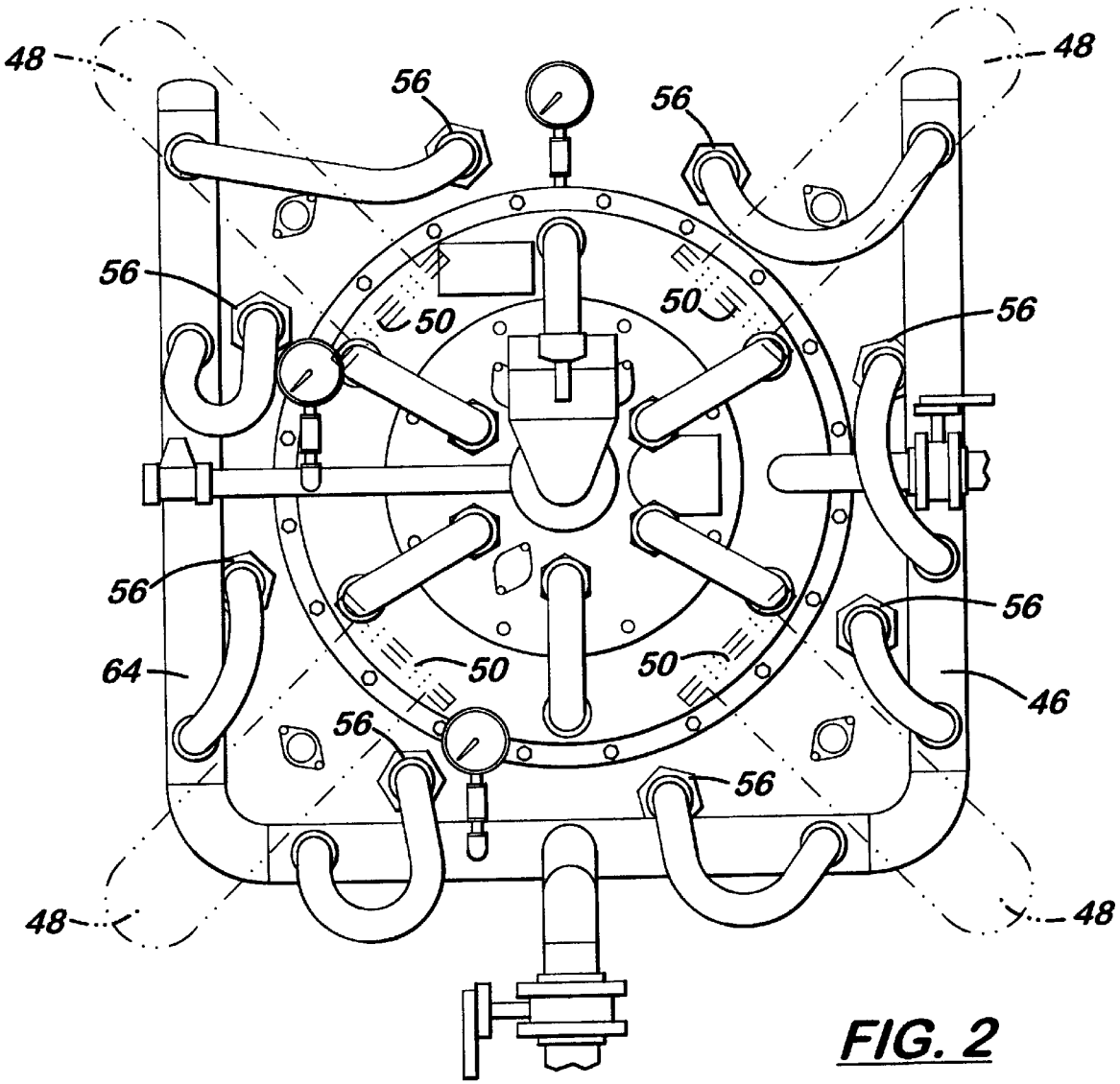
FIG. 2 is a front end elevational view of the burner of FIG. 1.

In accordance with the concepts and principles of the invention, the burner assembly may also include at least one fuel gas poker 44 for delivering fuel gas to the air traveling through the venturi tube 22 on its way to the combustion zone 14. Although only a single poker 44 is shown in FIG. 1, the burner assembly 10 may preferably include three or more fuel gas pokers 44 spaced evenly around the inside of the venturi tube 22. Conventionally the burner may include six to eight pokers 44 as illustrated in FIG. 2. However, if the invention of U.S. Pat. No. 5,860,803 to Schindler et al. which issued on Jan. 19, 1999 (the "'803 patent") is employed, the burner 10 may need only three pokers 44. The entirety of the disclosure of the '803 patent is hereby incorporated herein by reference. The pokers 44 may each include an elongated tube 45 and a nozzle 47, and the same may conventionally be linked together by a fuel gas manifold 46 as shown in FIG. 2. The principal design consideration in selecting the correct number of three or more pokers for any given installation is that the poker gas be distributed evenly around the entire circumference of the venturi tube 22.

Desirably burner assembly 10 of the invention may include one or more ducts 48 for internal recirculating flue gas 49 from a point within the combustion chamber 16 adjacent combustion zone 14 to the air flowing through venturi tube 22 at the low pressure zone 72 in throat 24 thereof. A single duct 48 is shown in FIG. 1 for illustrative purposes. However, burner assembly 10 preferably may include four or more ducts 48 spaced 90 degrees apart around the periphery of the venturi tube 22 as best shown in FIG. 2. Again, the principal design consideration in selecting the correct number of ducts 48 for a given application is simply that the recirculated flue gas be distributed evenly around the entire circumference of the venturi tube. Ducts 48 may each be provided with an outlet 50 which is connected to the venturi tube at a point adjacent to the low pressure zone 72 at the throat 24 of the venturi tube 22 so that recirculated flue gas 49 is inducted into the venturi tube 22. Each duct 48 also preferably has an inlet 52 which is in fluid communication with the interior of the combustion chamber via an opening 54 in wall 20. Thus, flue gas 49 from adjacent the combustion zone 14 in chamber 16 may be inducted into the air flowing through the venturi tube 22 and intermixed therewith at throat 24.

As is illustrated in FIG. 1, the burner 10 of the invention may also be provided with at least one external fuel gas injector 56. The injector 56 may preferably include an elongated tube 58 and a injector nozzle 60. The injector nozzle 60 protrudes through an opening 62 which extends through wall 20 such that the injector nozzle 60 is positioned in outwardly spaced relationship relative to entrance 18. That is to say, opening 62 is positioned outwardly beyond the inner edge surface 30 of entrance 18 and therefore the injector nozzle 60 is positioned to direct a flow of injector fuel gas into said combustion chamber 16 at a location adjacent to and externally of the combustion air flowing into combustion zone 14.

A single fuel gas injector 56 is shown in FIG. 1 for illustrative purposes. However, as shown in FIG. 2, the burner assembly 10 may preferably include four to twelve fuel gas injectors 56 spaced 45 degrees apart around the periphery of the venturi tube 22. Again, the principal design consideration in selecting the correct number of fuel gas injectors 56 for a given application is that the fuel gas be distributed evenly around the entire periphery of the combustion zone 14. The injectors 56 are provided with a manifold 64 which distributes fuel gas thereto.

In operation, combustion air enters the burner 10 from windbox 12 and is preferably divided into at least three separate and distinct portions. The flow path of the central (primary plus secondary) air is designated by the arrow 66, the flow path of tertiary air is designated by the arrow 68 and the flow path of quaternary air is designated by the arrow 70. As dictated by the shape and size of the venturi tube 22, the shape and configuration of the swirler 34 and the shape and size of the entrance 18, flow 66 of primary and secondary air moves to the center of the venturi tube 22 where the same is mixed with fuel gas from the central fired gas gun 40. The mixture of fuel gas and central air is then directed through the swirler 34 which rotates the mixture in a manner well known to the routineers in the burner art. The swirler 34 operates to thoroughly mix the central flow 66 of primary and secondary air with the central fired gas gun flow of fuel gas from nozzle 40. Moreover, the swirler 34 operates to create toroidal vortexes in the central air/fuel gas mixture in front of the swirler. This thoroughly mixed central mixture of air and fuel gas is then directed into the center core of the combustion zone 14. In accordance with the invention, the central air 66 may preferably be divided into concentric primary and secondary air flow portions 102, 104 for a purpose described hereinafter. These concentric flows are illustrated particularly in FIG. 4.

Tertiary air 68 moves in a generally straight line through the venturi tube 22 and passes into the combustion zone. As tertiary air 68 passes around the swirler 34, it is in the shape of an annular envelope that surrounds the swirler 34 and the swirled primary and secondary air portions 102 and 104. As can be seen viewing FIG. 1, the fuel gas pokers 44 are positioned radially outwardly relative to the swirler 34 and such that the fuel gas from the poker nozzles 47 is intermixed with the tertiary air 68. Thus, straight line tertiary air 68 and the fuel gas flows from poker nozzles 47 are directed in a straight line into the combustion zone 14 at a position which is radially outward of the center of the latter.

Quaternary air 70 moves in a straight line around the periphery of the venturi tube 22 and is guided by the mouth 35 so that it passes through the gap 32 between the outlet end 26 of the venturi tube 22 and the inner edge surface 30 of the entrance 18. The quaternary air 70 is in the shape of an annulus which surrounds the venturi tube 22 and the tertiary air 68 as it is introduced into the combustion zone 14.

Fuel gas from the injectors 56 may be introduced into the combustion chamber 16 at a position which is radially outward relative to the center of the combustion zone 14 and to the primary, secondary, tertiary and quaternary air flows 102, 104, 68 and 70.

Generally speaking, the outlet end of the venturi tube 22 may preferably be about 6 to about 40 inches in diameter. The shape of the venturi tube 22 is not necessarily critical to the operation of the burner 10. That is to say, the shape of the venturi tube is in some measure dictated by the desired air flow rate characteristics. However, it has been determined experimentally that the venturi tube 22 may preferably be shaped such that the ratio of the diameter of the throat 24 to the diameter of the outlet end 26 may preferably be in the range of from about 1:1.2 to about 1:1.6. It has also been determined experimentally that the ratio of the total cross-sectional area of the annular gap 32 to the total cross-sectional area of the outlet end 26 of the venturi tube 22 may preferably, but not necessarily, be in the range of from about 1:6 to about 1:8. It is also preferred, but not necessarily required, that the swirler 34 be positioned at a distance from the outlet end 26 of the venturi tube which is within the range of from about 0.4 to about 0.6 times the internal diameter of outlet end 26.

Figure 3:
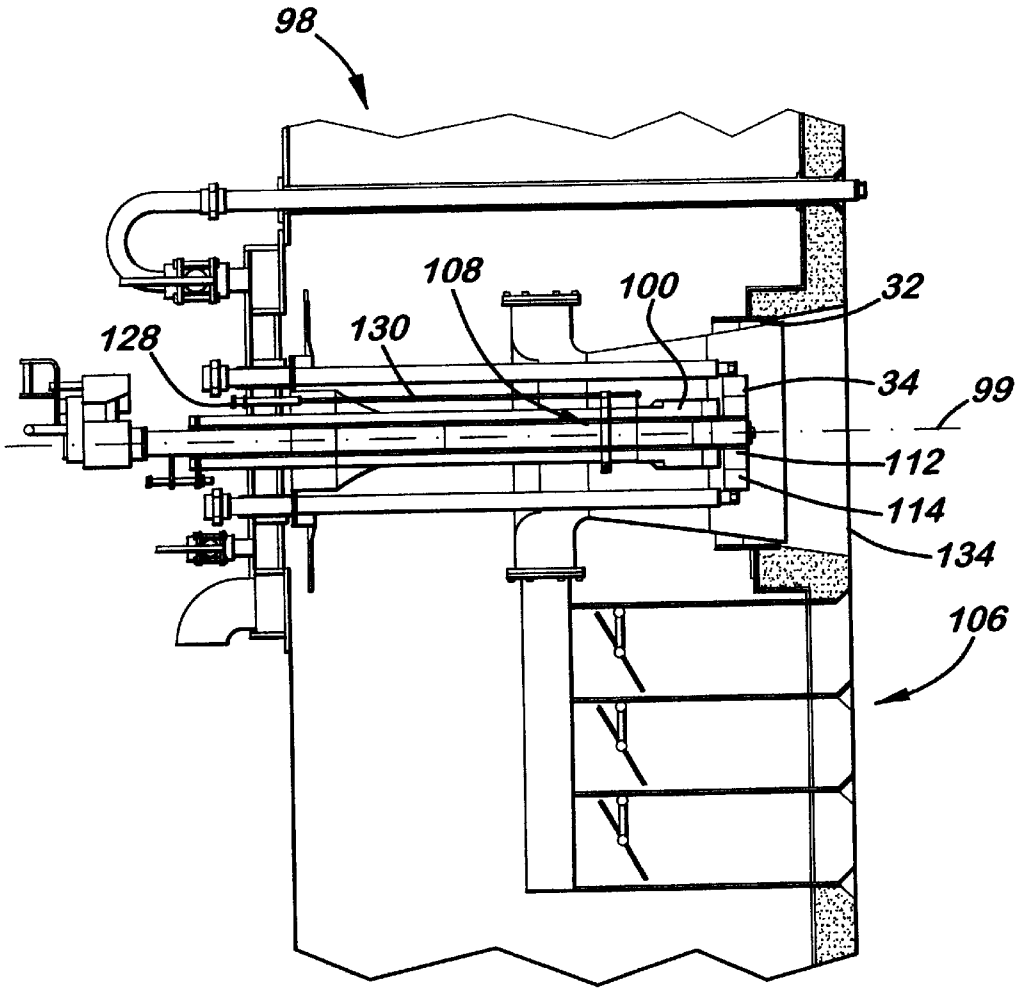
FIG. 3 is a schematic sectional elevational view of another embodiment of a burner assembly which incorporates the principles and concepts of the invention.

The difference between the forward velocity of the swirled primary and secondary air streams 102 and 104 and the forward velocity of the straight line tertiary air stream 68 is associated with the physical design of the burner. Conceptually, all of the central air stream 66 passes through the swirler 34. On the other hand, the tertiary stream 68 passes around the swirler 34 and theoretically none of it passes through the swirler 34. Clearly none of the quaternary air flow 70 passes through the swirler 34. The swirler 34 imposes a degree of aerodynamic resistance on the primary and secondary streams 102 and 104 passing therethrough. Thus, the velocities of the straight line streams 68 and 70 are greater than the velocity of the swirled primary and secondary streams 102 and 104. With reference to FIG. 3 of the '007 application referred to above, it can be seen that when the ratio of swirled central air flow 66 to straight line air flow (tertiary +quaternary) is greater than about 0.2, air resistance increases rapidly. On the other hand, when the ratio of the swirled central air flow to straight line air flow is less than about 0.08, flame stability problems occur. From these parameters, the preferred relative air flow velocities may be determined. Thus, in actual operation, it is preferred that the ratio of the forward velocity of the swirled primary and secondary air streams 102 and 104 to the forward velocities of the straight line air streams 68 and 70 should be in the range of from about 1:1.1 to about 1:1.5.

A second embodiment of a burner assembly which embodies the principles and concepts of the invention is illustrated in FIG. 3 where it is identified by the reference numeral 98. Many of the components and features of burner assembly 98 are essentially the same as corresponding components and features of burner assembly 10. These components and features will be referred to using the same reference numerals that have been used above in describing burner assembly 10. To the extent that new components and/or features are included in burner assembly 98, these will be referred to using new reference numerals.

Figure 4:
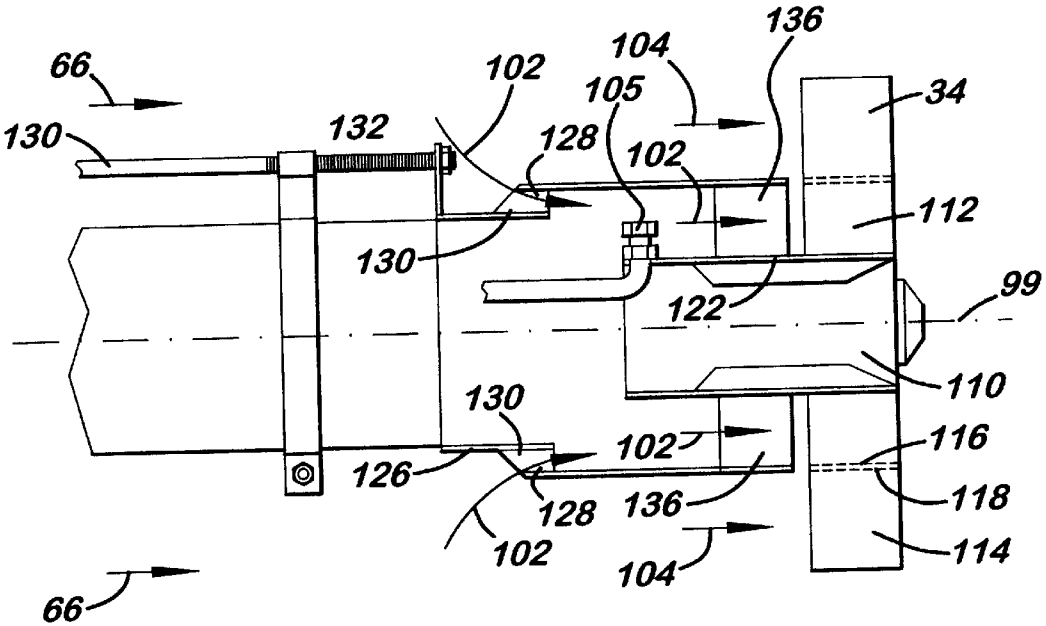
FIG. 4 is an enlarged cross sectional view illustrating a baffle structure of the central fired gas (CFG) gun interaction with a swirler of the burner assembly of FIG. 3 which is used for dividing the central air into two separate portions.

Burner assembly 98 includes a special internal baffle structure 100 which is arranged for dividing the central air flow 66 into the concentric primary and secondary air flows 102 and 104. With reference to FIG. 4, the primary air flow is identified by the arrows 102 and the secondary air flow is identified by the arrows 104. The air flows 102 and 104 move generally in a direction that is parallel to the longitudinal axis 99 of burner assembly 98. Moreover, because of the shape of baffle structure 100, the secondary air flow 104 is generally annular in shape and the same is disposed so as to generally surround the primary air flow 102.

Baffle 100 is preferably constructed of a first cylindrical portion 124 and a second cylindrical portion 126. As can be seen from FIG. 4, portion 124 is larger in diameter than portion 126 and the portions 124, 126 are interconnected by a series of elements 128 which are shown as being trapezoidal in shape in the preferred embodiment of FIG. 4. Although only two elements 128 are shown in FIG. 4, the number thereof may preferably be at least three. Needless to say, the elements 128 are preferably spaced evenly about the circumference of the portions 124, 126 and elements 128 are attached to the portions 124, 126 by welding or the like so that these portions 124, 126 are securely attached to one another. The foregoing construction provides a generally annular slot 130 located between portions 124, 126. As can be seen from FIG. 4, the position of slot 130 is instrumental in dividing the central air flow 66 into the primary and secondary portions 102 and 104.

Figure 5:
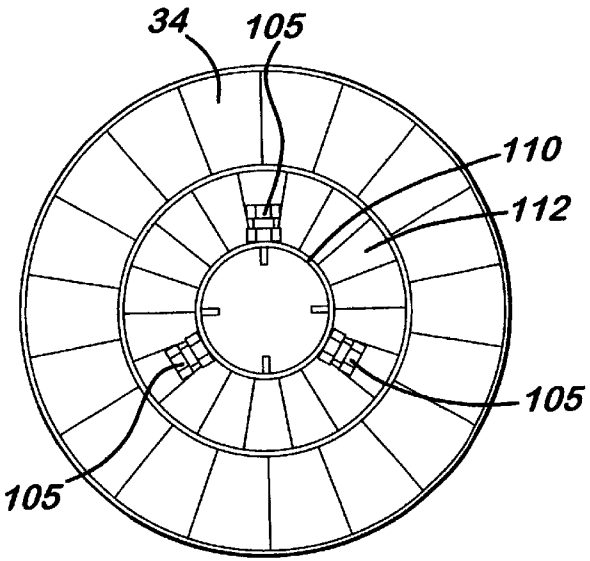
FIG. 5 is an end view of the swirler of FIG. 4.

Gas swirler 34 includes a central hub 110, a first generally annular swirler component 112 that is located in a position to swirl primary air flow 102 and a second annular swirler component 114 that is located in a position to swirl secondary air flow 104. Component 112 has an outer circumferential edge 116 that extends around axis 99 in radially spaced relationship thereto, and component 114 has an internal annular edge 118 that also extends around axis 99. As can be seen from FIGS. 4 and 5, swirler component 112 is mounted on hub 110 with its internal edge 120 abutting the outer periphery 122 of hub 110. It can also be seen that swirler component 114 is mounted on swirler component 112 with its internal edge 118 abutting the outer edge 116 of component 112. In the preferred arrangement shown in FIGS. 4 and 5, it can be seen that swirler components 112 and 114 are located generally in a common plane which extends transversely, preferably perpendicularly of axis 99. It is to be noted that as a result of the arrangement of components 112 and 114, the secondary airflow 104 is swirled independently of the swirling of the primary air flow 102.

Fuel gas is provided via one or more central nozzles 105 for intermixing with the primary air flow 102. The nozzles 105 (items 40 in FIG. 1) may be mounted on hub 120 as shown; however, as would be recognized by one skilled in the art, the nozzles 105 may just as well be mounted in some other way. In this regard there are any number of alternative configurations for mounting fuel nozzles that are well know in the burner art. Air flow 104 is generally and preferably free of fuel gas. Only a single nozzle 105 is shown in FIG. 4 for convenience; however, those skilled in the art will appreciate the fact that the actual number of nozzles 105 to be employed for any given installation may vary depending upon the physical size and configuration of the burner and the operational conditions. These nozzles 105 should preferably be spaced evenly in the center of cylindrical portion 124 so that the fuel is distributed evenly in air flow 102. The gas flowing from cylindrical portion 124 and thence through swirler component 112 generally comprises a mixture of air and fuel gas for the burner. Thus, cylindrical portion 124 presents a central fired gas gun for providing a stable ignition point for the burner. The annularly shaped secondary air flow 104 flowing along the outside of portion 124 and through swirler component 114 generally comprises pure air.

Figure 9:
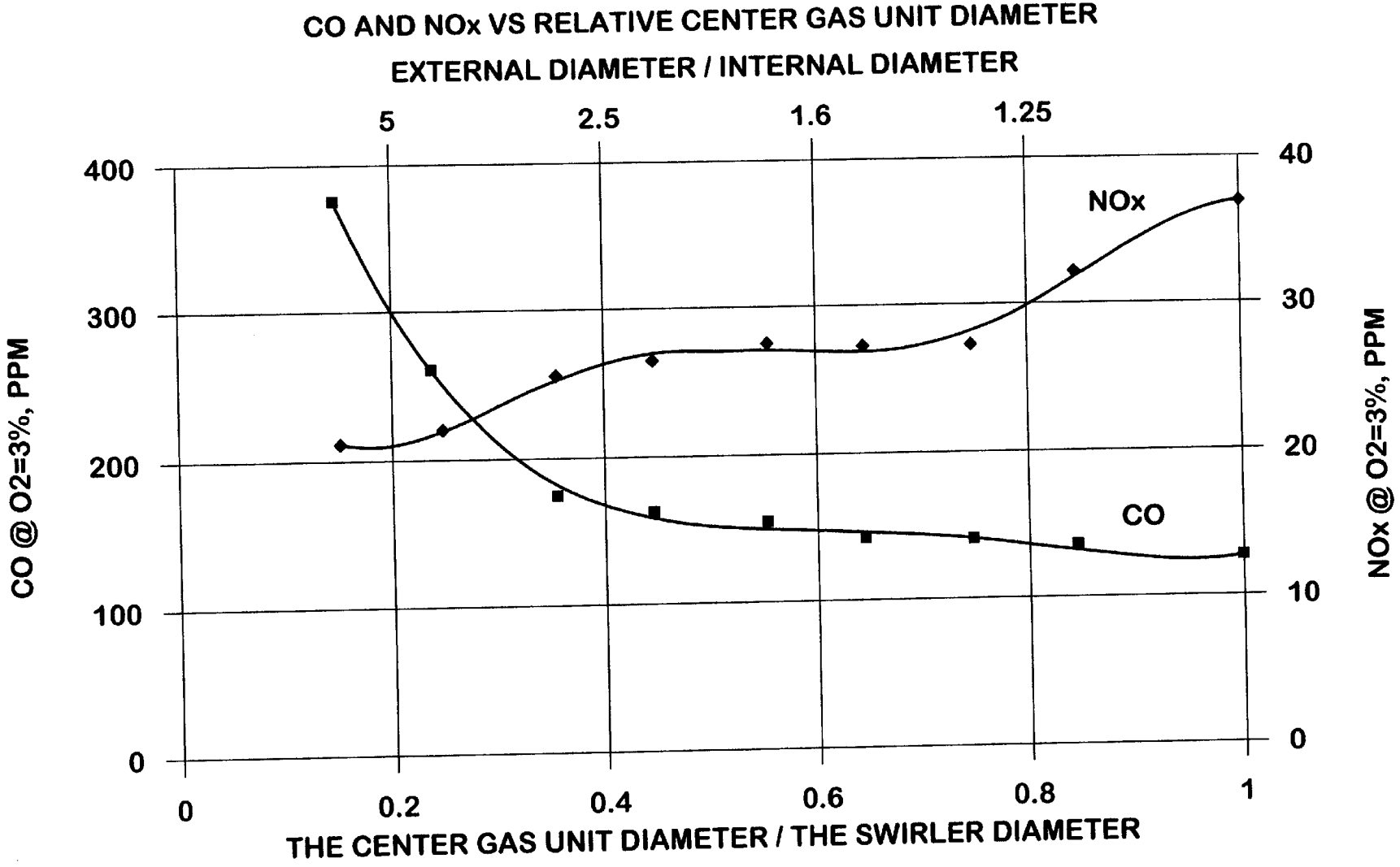
FIG. 9 is a chart comparing effluent CO and $NO_x$ emissions with the ratio of the diameter of the inner swirler component to the diameter of the outer swirler component.

Swirler component 112 is positioned to swirl the mixture of primary air 102 and fuel which passes therethrough so as to intimately intermix these components. As is known by those skilled in the burner art, the degree and direction of the swirl imposed on the mixture may be determined by the physical and desired operational characteristics of the burner. Swirler component 114 is positioned to swirl secondary air flow 104. The swirled secondary air flow 104 generally becomes mixed immediately with the swirled primary air/fuel gas mixture exiting from swirler component 112. Preferably the direction and intensity of the swirl imposed on secondary air flow 104 by component 114 should be essentially the same as the direction and intensity of the swirl imposed on the mixture of primary air 102 and fuel gas by component 112. As can be seen viewing FIG. 9, it has been determined empirically that the ratio of the outer diameter of swirler component 114 to the outer diameter of swirler component 112 should preferably be approximately within the range of from about 1.5 to about 1.8 to achieve both relatively low CO and relatively low $NO_x$.

Figure 6:
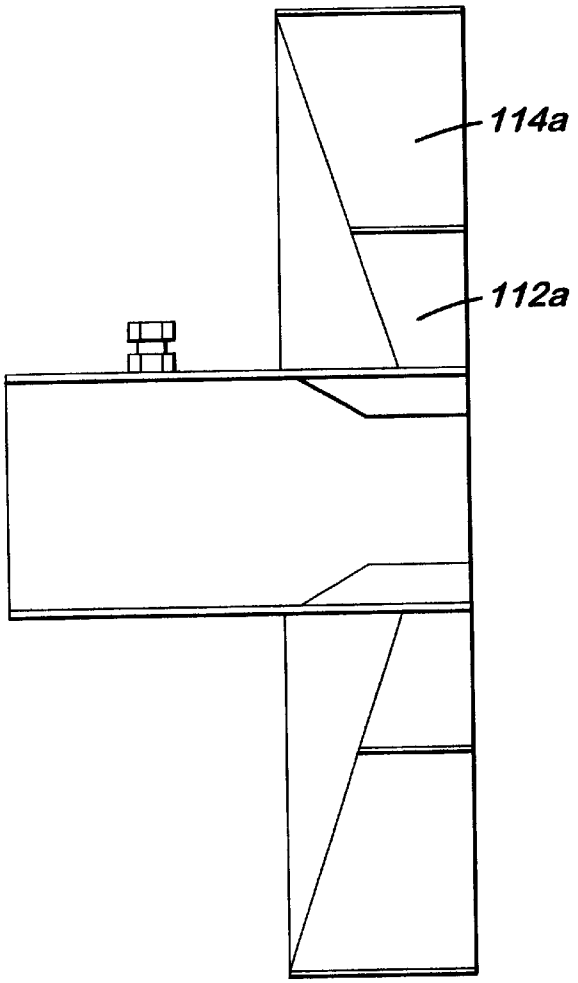
FIG. 6 is an elevational view illustrating another embodiment of the swirler of the invention.

In FIG. 4, the respective widths of swirler components 112 and 114 is approximately the same. This is not a critical feature of the invention. In this regard, an alternative embodiment of the swirler of the invention is illustrated in FIG. 6 where it can be seen that the rear surfaces of the components are beveled such that the overall thickness of the outer component 114*a* is greater than the overall thickness of the inner component 112*a*. Other configurations are possible in accordance with the concepts and principles of the invention which dictate only that air flow 104 be swirled substantially separately from the swirling of the mixture of fuel gas and primary air flow 102.

Figure 7:
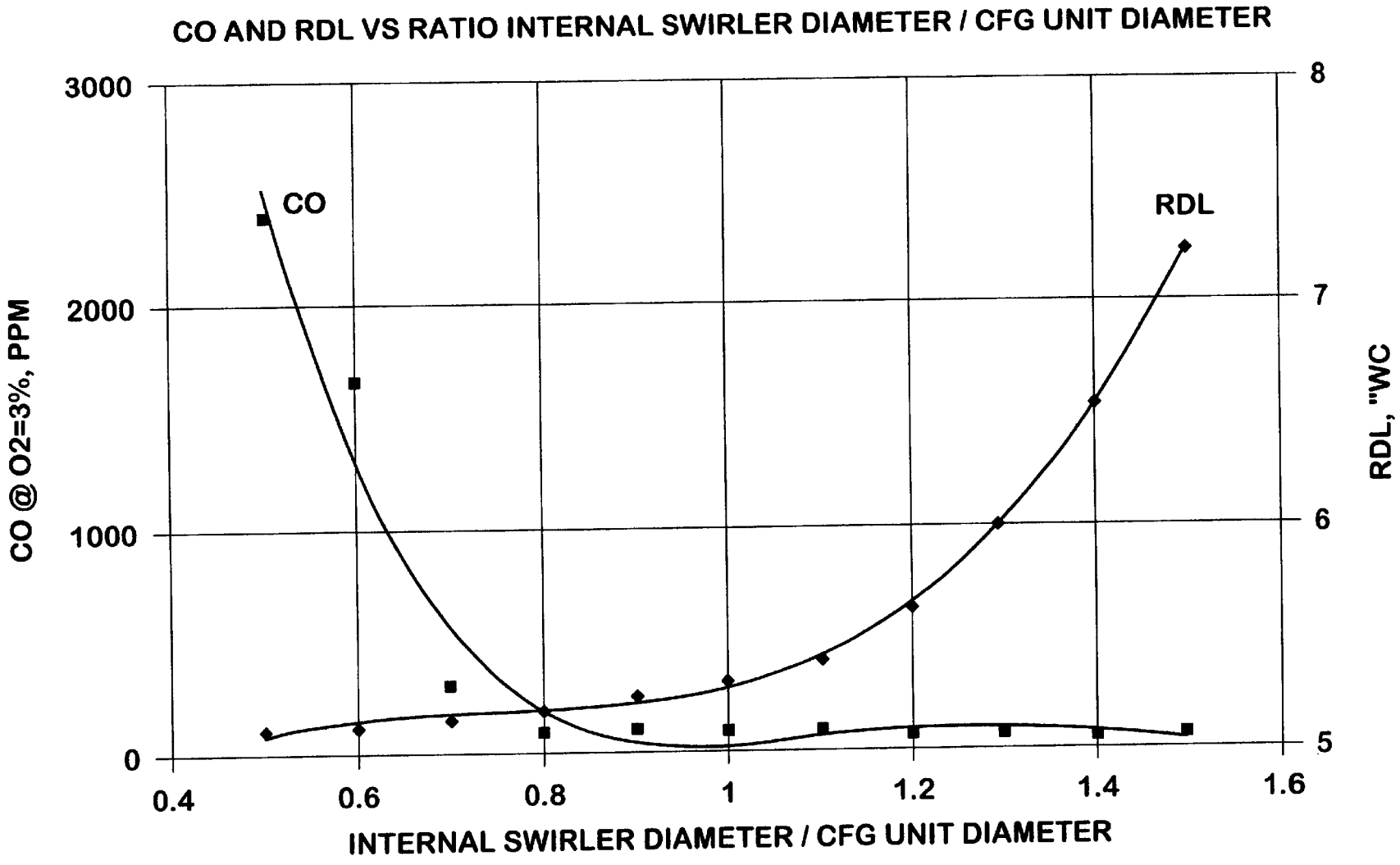
FIG. 7 is a chart comparing CO concentration in effluent gases and operating pressure drop, sometimes referred to as register draft loss (RDL), with the ratio of internal swirler diameter to central fired gas gun diameter.

As shown in FIG. 4, the diameter of cylindrical portion 124 ideally is essentially the same as the external diameter of swirler component 112. However, this configuration is not critical to the invention. And as can be seen viewing FIG. 7, favorable results may be achieved if the diameter of portion 124 is somewhat smaller or somewhat larger than the outer diameter of swirler component 112. In fact, it has been found experimentally that the ratio of the outer diameter of swirler component 112 to the diameter of portion 124 may preferably be within the range of from about 0.8 to about 1.2.

Burner assembly 98 also includes a damper system 106 which may be used to control the amount of flue gas that is recirculated under the influence of the venturi tube as described above. In addition, assembly 98 includes an adjustment mechanism 108 for changing the axial position of baffle structure 100 and swirler 34 relative to the venturi tube.

Figure 8:
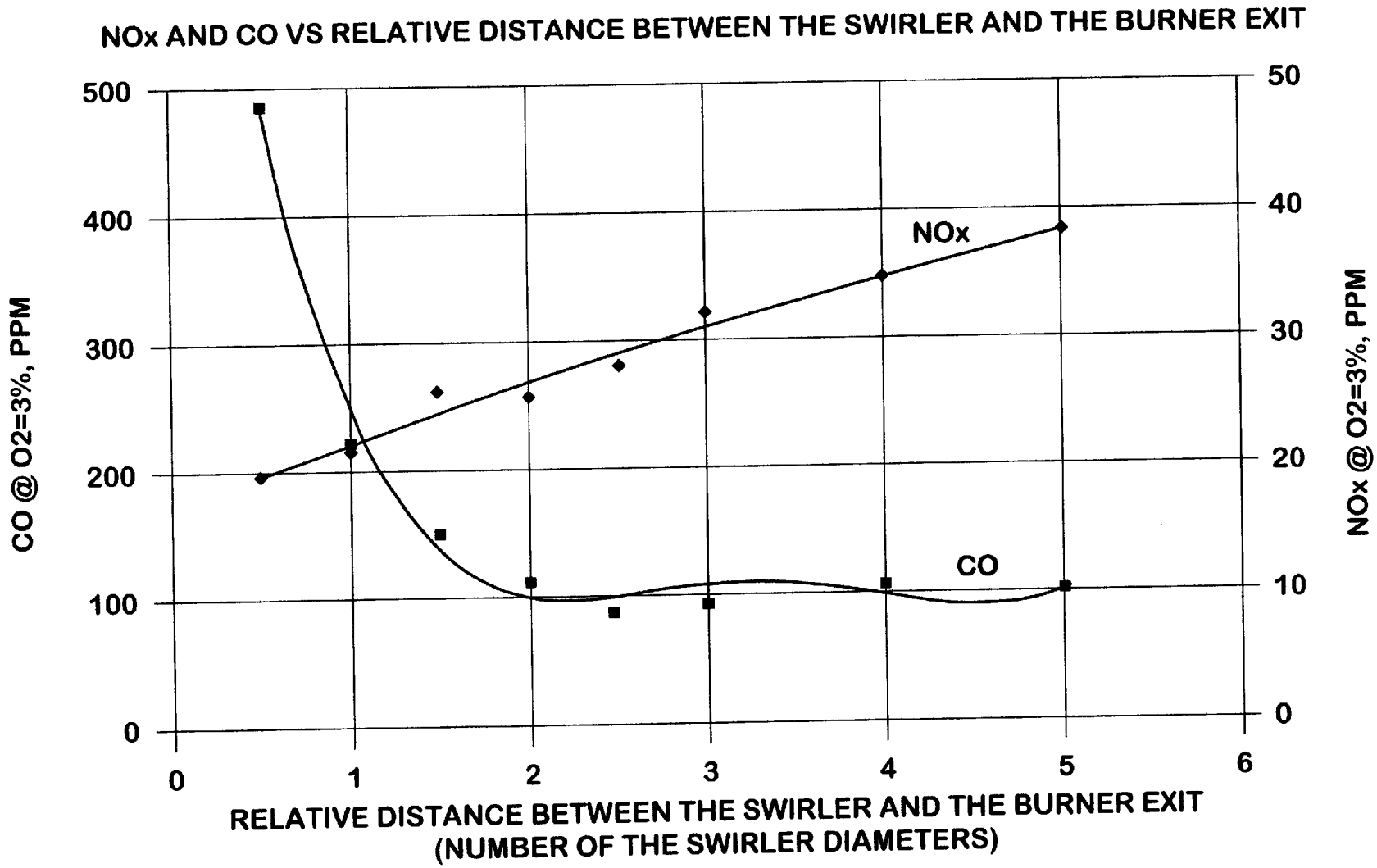
FIG. 8 is a chart comparing effluent CO and $NO_x$ emissions with the relative distance from the swirler to the burner exit.

Adjustment mechanism 108 comprises a handle 128 and an elongated rod 130. When handle 128 is rotated, elongated rod 130 moves longitudinally. With reference to FIG. 4, it can be seen that the free end 132 of rod 130 is attached securely to cylindrical portion 126 so that the entire baffle structure 100 is moved longitudinally toward and away from the exit plane 134 of the burner assembly 98. It is to be noted that swirler 34 is mounted directly on cylindrical portion 124 by a series of plates 136 which are attached by welding or the like. Thus, swirler 34 also moves toward and away from exit plane 134 when handle 128 is rotated. Ideally, swirler 34 may be positioned such that the distance between exit plane 134 and swirler 34 is equal to the outer diameter of component 114. However, such positioning of the swirler is not critical, and it has been found experimentally, as shown in FIG. 8, that generally satisfactory results may be achieved when the ratio of the distance between swirler 34 and exit plane 134 and the outer diameter of component 114 is in the range of from about 1.5 to about 2.5.

Figure 10:
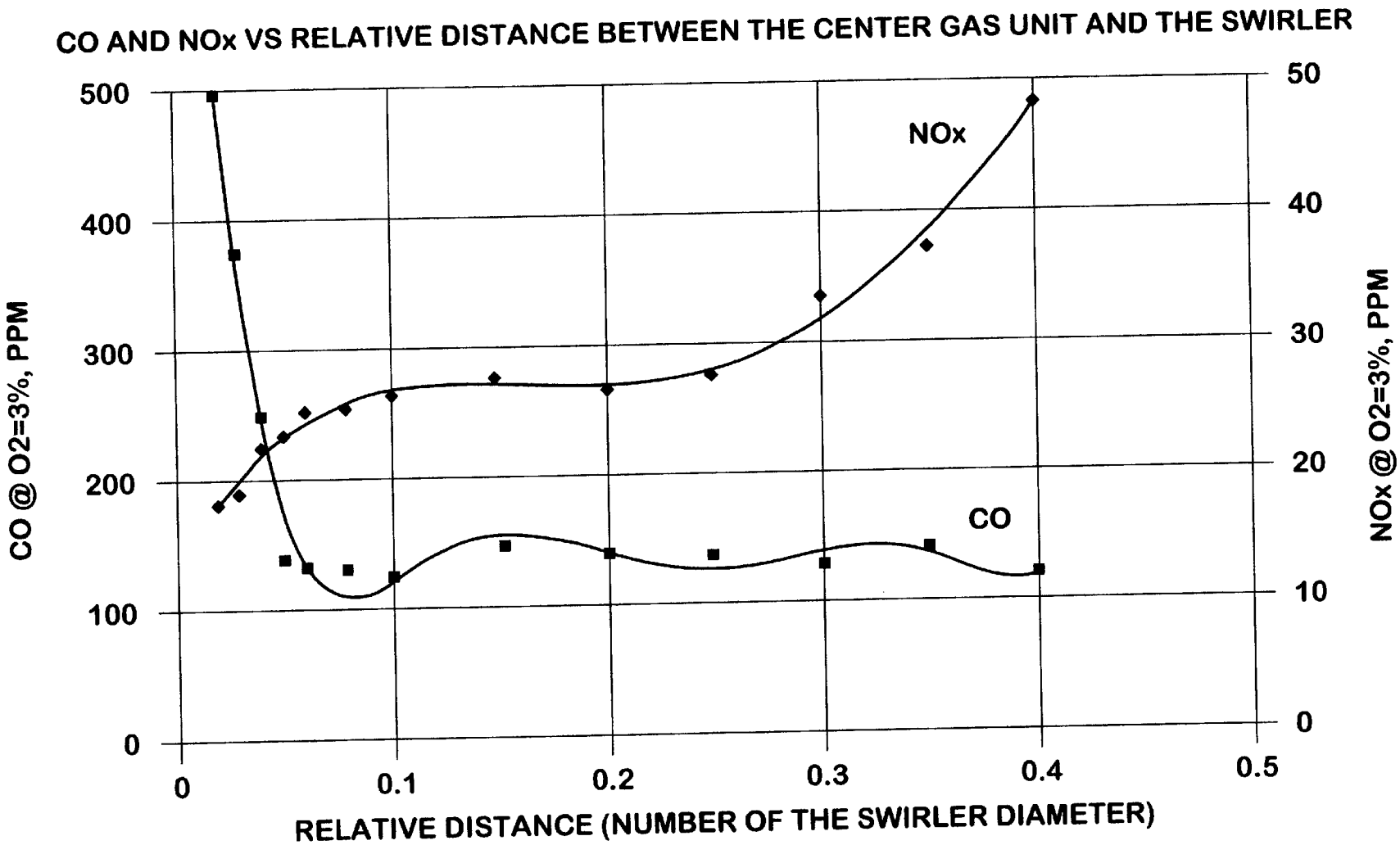
FIG. 10 is a chart comparing effluent CO and $NO_x$ emissions with the relative distance from the central fired gas gun to the swirler.

With reference to FIG. 10, it has also been determined empirically that the relative distance from the nozzles 105 to the swirler 34 may influence burner operational characteristics. Thus, it has been determined that both CO and $NO_x$ may be maintained at a relatively low level when the ratio of the distance between nozzles 105 and swirler 34 to the outer diameter of swirler 34 is in the approximate range of from about 0.05 to about 0.25.

We claim:

1. An air swirler structure for an elongated industrial burner adapted for burning either liquid or gaseous fuels, said burner having a central axis and being configured and arranged to provide concentric primary and secondary air flows moving in a direction generally parallel to said axis, said primary air flow being surrounded by said secondary air flow, said swirler structure comprising:

a first swirler component located in said primary air flow for swirling the primary air flow, said first swirler component having an outer edge that extends around said axis in radially spaced relationship thereto; and a second generally annular swirler component located in said secondary air flow for swirling said secondary air flow independently of the swirling of the primary air flow, said second swirler component having an internal edge that extends around said axis in spaced relationship thereto, said internal edge of the second swirler component being greater in diameter than said outer edge of the first swirler component, the arrangement being such that the swirled secondary air flow is in direct contact with the swirled primary air flow as said air flows exit their respective swirler components.

2. A swirler as set forth in claim 1, wherein said swirler components are arranged in a common plane that extends transversely relative to said axis.

3. A swirler as set forth in claim 1, wherein said swirler components are arranged in a common plane that extends perpendicularly relative to said axis.

4. A swirler as set forth in claim 1, wherein said primary air flow comprises a mixture of air and fuel gas for the burner.

5. A swirler as set forth in claim 1, wherein said first swirler component is generally annular in shape and has an inner circular edge, and said swirler structure includes a centrally located, elongated cylindrical hub that extends along said axis in coaxial relationship thereto said inner circular edge being disposed in generally surrounding relationship relative to an outer periphery of said hub.

6. A swirler as set forth in claim 5, wherein said primary air flow comprises a mixture of air and fuel gas for the burner.

7. A swirler as set forth in claim 1, wherein said swirler components are each generally annular in shape and second swirler component has an outer peripheral rim having a diameter that ranges from about 1.5 to about 1.8 times the diameter of the outer edge of the first swirler component.

8. A swirler as set forth in claim 1, wherein said swirler components are arranged to swirl the respective primary and secondary air flows in the same general direction.

9. A swirler as set forth in claim 1, wherein said swirler components are arranged to swirl the respective primary and secondary air flows with essentially the same intensity.

10. A swirler as set forth in claim 8, wherein said swirler components are arranged to swirl the respective primary and secondary air flows with essentially the same intensity.

11. An industrial burner assemblage adapted for burning either liquid or gaseous fuels comprising:

an elongated, round burner assembly having a central axis and including internal baffle structure causing concentric primary and secondary air flows to move in a direction generally parallel to said axis, said secondary air flow being generally annular in shape and disposed in generally surrounding relationship relative to said primary air flow; and a swirler structure for swirling said air flows, said swirler structure comprising a first swirler component located in said primary air flow for swirling said primary air flow, said first swirler component having an outer circumferential edge that extends around said axis in radially spaced relationship thereto, and a second generally annular swirler component located in said secondary air flow for swirling said secondary air flow independently of the swirling of the primary air flow, said second swirler component having an internal annular edge that extends around said axis in spaced relationship thereto, said internal annular edge being greater in diameter than said outer circumferential edge of the first swirler component, the arrangement being such that the swirled secondary air flow is in direct contact with the swirled primary air flow as said air flows exit their respective swirler components.

12. A burner assemblage as set forth in claim 11, wherein said first swirler component is annular and said swirler structure includes a centrally located, elongated cylindrical hub that extends along said axis in coaxial relationship thereto, said first swirler component having an inner circular edge that extends around an outer periphery of said hub.

13. A burner assemblage as set forth in claim 12, wherein said primary air flow comprises a mixture of air and fuel gas for the burner.

14. A burner assemblage as set forth in claim 11, wherein said second swirler component has an outer peripheral rim.

15. A burner assemblage as set forth in claim 14, wherein said primary and secondary air flows together provide a central air flow of said burner and said internal baffle structure includes at least one baffle element directing a flow of tertiary air through said burner assembly along said axis, said tertiary air flow being annular in shape, concentric with said axis and located in surrounding relationship to the outer peripheral rim of the second swirler component.

16. A burner assemblage as set forth in claim 15, wherein the outer peripheral rim of said second swirler component has a diameter that ranges from about 1.5 to about 1.8 times the diameter of the outer peripheral edge of the first swirler component.

17. A burner assemblage as set forth in claim 15, comprising a venturi tube arranged so that said primary, secondary and tertiary air flows flow therethrough.

18. A burner assemblage as set forth in claim 11, wherein said swirler components are arranged to swirl the respective primary and secondary air flows in the same general direction.

19. A burner assemblage as set forth in claim 11, wherein said swirler components are arranged to swirl the respective primary and secondary air flows with essentially the same intensity.

20. A burner assemblage as set forth in claim 19, wherein said swirler components are arranged to swirl the respective primary and secondary air flows with essentially the same intensity.

21. A burner assemblage comprising:

an elongated, venturi tube burner assembly having a central axis and including internal baffle structure causing concentric primary and secondary air flows to move in a direction generally parallel to said axis, said secondary air flow being generally annular in shape and disposed in generally surrounding relationship relative to said primary air flow; and a swirler structure for swirling said air flows, said swirler structure comprising a first swirler component located in said primary air flow for swirling said primary air flow, said first swirler component having an outer circumferential edge that extends around said axis in radially spaced relationship thereto, and a second generally annular swirler component located in said secondary air flow for swirling said secondary air flow independently of the swirling of the primary air flow, said second swirler component having an internal annular edge that extends around said axis in spaced relationship thereto, said internal annular edge being greater in diameter than said outer circumferential edge of the first swirler component, wherein the burner assembly is constructed and arranged to direct a quaternary flow of air around the outside of the venturi tube.

22. A method for operating an elongated, round industrial burner assembly adapted for burning either liquid or gaseous fuels and having a central axis, said method comprising:

providing a flow of combustion air for the burner assembly;

dividing said flow of combustion air into concentric primary and secondary air flows, said secondary air flow being generally annular in shape and disposed in generally surrounding relationship relative to said primary air flow;

causing said primary and secondary air flows to move through said burner assembly in a direction generally parallel to said axis;

swirling said primary air flow in a first direction at a first swirling intensity; and independently swirling said secondary air flow in a second direction at a second swirling intensity, causing the swirled secondary air flow and the swirled primary air flow to be in direct contact with one another immediately downstream from said swirling operations, independently swirling said secondary air flow in a second direction at a second swirling intensity.

23. A method as set forth in claim 22, wherein the primary and secondary air flows are independently swirled in essentially the same swirling direction.

24. A method as set forth in claim 22, wherein the primary and secondary air flows are independently swirled at essentially the same intensity.

25. A method as set forth in claim 23, wherein the primary and secondary air flows are independently swirled at essentially the same intensity.

* * * * *

UNITED STATES PATENT AND TRADEMARK OFFICE

CERTIFICATE OF CORRECTION

PATENT NO. : 6,524,098 B1 
DATED : February 25, 2003
INVENTOR(S) : Lev Tsirulnikov et al.

It is certified that error appears in the above-identified patent and that said Letters Patent is hereby corrected as shown below:

Column 12,
Line 12, delete the comma "," and replace with a period -- . --.
Lines 13 and 14, delete both lines from "independently" through and including "intensity.".

Signed and Sealed this

Twenty-third Day of September, 2003

JAMES E. ROGAN
*Director of the United States Patent and Trademark Office*